US011014222B2

(12) United States Patent
Hohmann et al.

(10) Patent No.: US 11,014,222 B2
(45) Date of Patent: May 25, 2021

(54) NUT RUNNER

(71) Applicants: Jorg Hohmann, Meschede (DE); Frank Hohmann, Warstein (DE)

(72) Inventors: Jorg Hohmann, Meschede (DE); Frank Hohmann, Warstein (DE)

( * ) Notice: Subject to any disclaimer, the term of this patent is extended or adjusted under 35 U.S.C. 154(b) by 242 days.

(21) Appl. No.: 14/983,668

(22) Filed: Dec. 30, 2015

(65) Prior Publication Data

US 2016/0207180 A1 Jul. 21, 2016

(30) Foreign Application Priority Data

Jan. 20, 2015 (DE) ..... 10 2015 000 555

(51) Int. Cl.

| | |
|---|---|
| ***B25B 23/147*** | (2006.01) |
| ***B25B 23/00*** | (2006.01) |
| ***B25B 21/00*** | (2006.01) |
| *B25B 23/14* | (2006.01) |
| *B25B 23/142* | (2006.01) |

(52) U.S. Cl.

CPC ..... *B25B 23/147* (2013.01); *B25B 21/00* (2013.01); *B25B 21/008* (2013.01); *B25B 23/0078* (2013.01); *B25B 23/14* (2013.01); *B25B 23/1405* (2013.01); *B25B 23/1425* (2013.01); *B25B 23/1475* (2013.01)

(58) Field of Classification Search

CPC ... B25B 23/147; B25B 23/0078; B25B 23/14; B25B 23/1405; B25B 23/1425; B25B 23/1475; B25B 21/00; B25B 21/008

USPC ..... 81/469, 467

See application file for complete search history.

(56) References Cited

U.S. PATENT DOCUMENTS 6,161,629 A * 12/2000 Hohmann ..... B23P 19/066 173/181
6,196,071 B1 3/2001 Shomo
6,311,786 B1 11/2001 Giardino et al.
(Continued)

FOREIGN PATENT DOCUMENTS

CN 103619542 A * 3/2014 ..... B25B 21/02
DE 10133923 A1 1/2003
(Continued)

OTHER PUBLICATIONS

German Office Action; German Patent Application No. DE 10 2015 000 555.3; dated Nov. 2, 2015; 5 pages.
(Continued)

*Primary Examiner* — Monica S Carter
*Assistant Examiner* — Katina N. Henson
(74) *Attorney, Agent, or Firm* — John H. Thomas, P.C.

(57) ABSTRACT

In a nut runner with a motor (3) for generating a torque, a tool holder (9) which is operatively connected with the motor (3) and transmits the generated torque to a tool, a measuring device (7) which continuously measures at least one measurement quantity for determining the torque and forwards the measurement value, and a control device (12) which is connected with the motor (3) and the measuring device (7) and controls the operation of the motor (3) such that after starting it generates a continuously increasing torque, and which shuts off the motor upon reaching a setpoint measurement value, the measuring device is a torque sensor (7) and the torque sensor (7) is arranged between the motor (3) and the tool holder (9).

8 Claims, 7 Drawing Sheets

(56) References Cited

U.S. PATENT DOCUMENTS

| | | | | |
|---|---|---|---|---|
| 2003/0188644 | A1* | 10/2003 | Winter | B30B 1/18 100/280 |
| 2010/0192705 | A1 | 8/2010 | Chu | |
| 2010/0265097 | A1* | 10/2010 | Obatake | B25B 21/00 340/870.4 |

FOREIGN PATENT DOCUMENTS

| | | | |
|---|---|---|---|
| DE | 10258900 | A1 | 7/2004 |
| DE | 102004021536 | A1 | 12/2005 |
| DE | 102004053288 | A1 | 5/2006 |
| DE | 202011004847 | U1 | 7/2011 |
| DE | 202011004979 | U1 | 1/2012 |
| DE | 102012017376 | A1 | 12/2013 |
| EP | 1270150 | A2 | 1/2003 |
| EP | 1614506 | A1 | 1/2006 |
| JP | H10329051 | A | 12/1998 |
| JP | 2006-021272 | A | 1/2006 |
| JP | 2010-247277 | A | 11/2010 |
| JP | 2011-173233 | A | 9/2011 |
| JP | 2012-125887 | A | 7/2012 |
| WO | 01/66338 | A2 | 9/2001 |
| WO | 03/006211 | A1 | 1/2003 |

OTHER PUBLICATIONS

European Patent Application No. EP 15003282; International Search Report dated Jun. 8, 2016; 5 pages.
Japan Patent Application Serial No. 2016-005935; Office Action dated Jan. 11, 2017; 4 pages.
Second European Search Report; Europe Application Serial No. EP15003282; dated Dec. 5, 2016; 5 pages.

* cited by examiner

NUT RUNNER

CROSS-REFERENCE TO RELATED APPLICATIONS

This is a United States Patent claiming priority from German Patent Application No. 10 2015 000 555.3 having a filing date of Jan. 20, 2015, the contents of which are incorporated herein by reference.

The invention relates to a nut runner with a motor for generating a torque, furthermore with a tool holder which is operatively connected with the motor and transmits the generated torque to a tool, a measuring device which continuously measures at least one measurement quantity for determining the torque and forwards the measurement value, and with a control device which is connected with the motor and the measuring device and controls the operation of the motor such that after starting it generates a continuously increasing torque, and which shuts off the motor upon reaching a setpoint measurement value.

Nut runners serve for tightening the nuts in screw connections. In the completely mounted screw connection the nut should be tightened with a desired or required setpoint torque. This setpoint torque is specified for the control device of the nut runner, for example via a setting device present at the nut runner and actuatable by the operator. When the motor is started, the nut to be tightened is rotated, wherein the tightening torque of the nut rises continuously. The setpoint torque is stored in a control software in a table function which is based on referencing between setpoint torque and motor current. Since the motor current also increases with increasing tightening torque, a referenced motor current is assigned to each setpoint torque to be set. The motor current is measured continuously by a measuring device and forwarded to an evaluation unit. Upon reaching the motor current associated to the setpoint torque, the control device receives a switch-off signal from the evaluation unit and switches off the motor. Therefore, the setpoint torque also is referred to as switch-off torque. The difference between the actually reached actual torque, at which the motor has been switched off by the control device, and the specified setpoint torque still can be relatively large.

It therefore is the object underlying the invention to improve a nut runner as mentioned above such that the setpoint torque is reached with greater accuracy.

According to the invention, this object is reached in a generic nut runner in that the measuring device is a torque sensor and the torque sensor is arranged between the motor and the tool holder Due to the measures according to the invention, the torque generated by the motor is measured directly and used for generating the switch-off signal. The control device therefore switches off the motor at an actual torque measured directly without any detours, whereby a difference to the specified setpoint torque can be reduced distinctly. In this way, an indirect measurement of the torque and the related inaccuracy are avoided.

Preferably, the torque sensor is arranged close to the tool holder. The closer the torque sensor is arranged to the tool which is to apply the torque onto the screw connection, the more exactly the actually applied torque can be measured. Thus, the torque sensor for example can be arranged in output direction directly before an output square forming the tool holder. A socket for tightening the nuts is put onto the output square, so that a torque sensor mounted directly before the same is arranged in direct vicinity of the nut which is rotated with the tightening torque.

In a favorable development of the invention a planetary transmission is arranged between motor and tool holder, which is operatively connected with both of them, and the torque sensor is part of the planetary transmission. Nut runners with planetary transmission are used in large screw connections—starting from M12—for tightening the nuts. The torques employed start at about 150 Nm and reach up to 13,000 Nm. To generate these torques, the motor drives a planetary transmission at whose end the tool holder is located, for example an output square on which a slip-on socket is adapted. When the torque sensor is part of the planetary transmission, it can be accommodated there in a space-saving manner, which provides for a relatively easy manufacture and assembly of the nut runner.

In addition, the torque sensor in this case also is accommodated within the nut runner housing and hence largely protected against damages.

In another embodiment of the invention it is, however, also possible to arrange the torque sensor on the outside of the nut runner housing. The torque sensor then is easily accessible and can be exchanged easily in the case of a damage.

Preferably, the motor is an electric motor. Electric motors merely require a power connection for energy supply and are low-maintenance and also relatively lightweight. The transport and handling of the nut runners thereby are simplified.

In an advantageous aspect of the invention the torque sensor and the control device are connected with an evaluation unit to which the torque sensor forwards the measured torques and from which the control device receives a switch-off signal for switching off the motor upon reaching a setpoint torque. In the evaluation unit a comparison of the generated torques with the setpoint torque takes place. A separate formation and arrangement of the evaluation unit makes the same independent of the formation and arrangement of the torque sensor and/or the control device, so that evaluation unit, torque sensor and control device can each as such be optimally designed and placed.

Preferably, the evaluation unit is arranged outside the nut runner. In this way, the measured torques of several nut runners in use can centrally be evaluated in a common evaluation unit. Hence, it also is possible to arrange the evaluation unit in the nut runner.

In a preferred embodiment of the invention the nut runner includes a wireless data transmission connection between torque sensor and evaluation unit and/or between evaluation unit and control device and/or between control device and motor. In a nut runner, no cable ducts must then be formed and no cables must be mounted, whereby the expenditure for manufacture and assembly of the nut runners is reduced distinctly.

Advantageously, a nut runner according to the invention has a data output for receiving the measured torques and for transmitting the same to an external data carrier. The measured torques and further data, such as associated times, in this way can be provided for archiving or possibly for a further, for example statistical, evaluation.

This data output preferably is equipped to wirelessly transmit the measured torques to an external data carrier. This also serves to avoid the formation of cable ducts and the assembly of cables, which further reduces the expenditure for manufacture and assembly of the nut runners.

In an advantageous development of the invention the data output is equipped to wirelessly transmit the measured torques to an evaluation unit, to receive the switch-off signal from the evaluation unit and to transmit the same to the control device, in order to switch off the motor. The evaluation unit can be arranged e.g. in a computer which is in data transmission connection with the data output. In this embodiment, the data output also is utilized as data input. The construction and manufacture of a nut runner with wireless data transmission can thereby be simplified further.

The invention will subsequently be explained in greater detail by way of example with reference to the drawings, in which.

Figure 1:
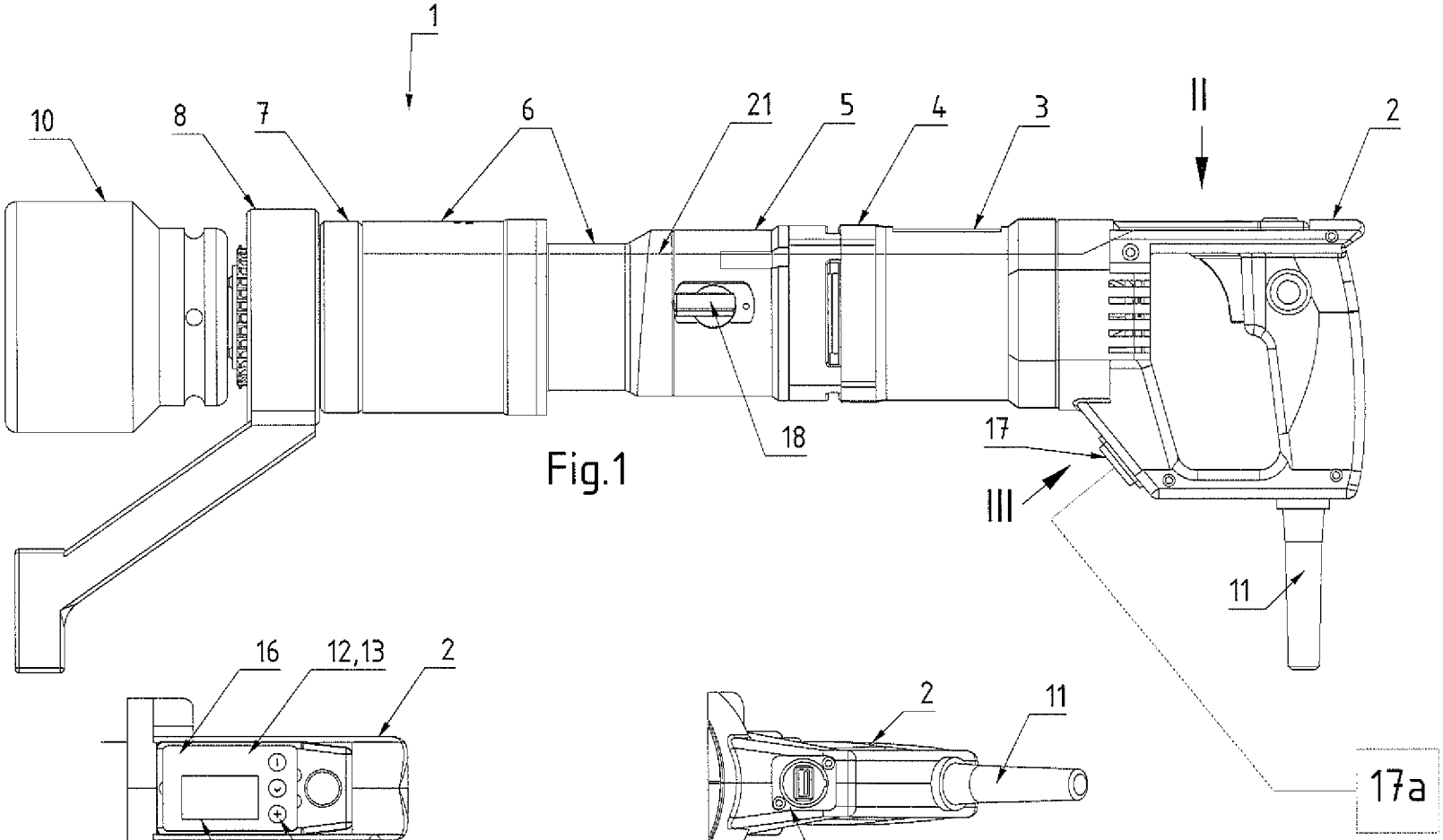
FIG. 1 shows a side view of a first embodiment of a nut runner according to the invention.

The exemplary embodiments of a nut runner 1 according to the invention as shown in the Figures in output direction one after the other include a handle 2, a motor 3, a rotary joint 4, a switch-over transmission 5, a planetary transmission 6 with a torque sensor 7 and a support arm 8 as well as an output square 9 with attached slip-on socket 10. The components are attached to each other in said order, wherein the torque sensor 7 and the support arm 8 are attached to the planetary transmission 6.

The motor 3 is an electric motor and is supplied with electricity via the handle 2 to which a power cable 11 is attached. The nut runner 1 can, however, also include a battery for power supply.

Figure 2:
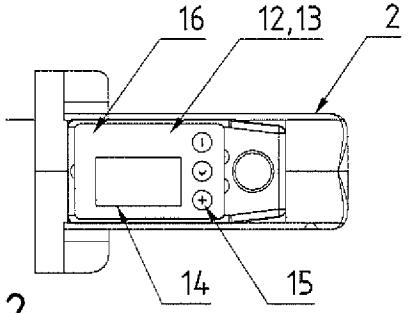
FIG. 2 shows detail II of FIG. 1.

In the handle 2 a control device 12 (FIG. 2) is present, which controls the operation of the motor 3. The control device 12 is equipped to control the operation of the electric motor 3 such that after starting it generates a continuously rising torque. Furthermore, the control device 12 is equipped to receive a switch-off signal from an evaluation unit 13 and upon receipt of the switch-off signal switch off the motor 3.

On the upper side of the handle 2 a display 14 and an input device 15 are arranged (FIG. 2), which are connected to the control device 12. At the input device 15, the setpoint or switch-off torque can be entered, at which the control device 12 is to switch off the motor.

Control device 12, display 14 and input device 15 are accommodated in a common electronic component 16.

Figure 3:
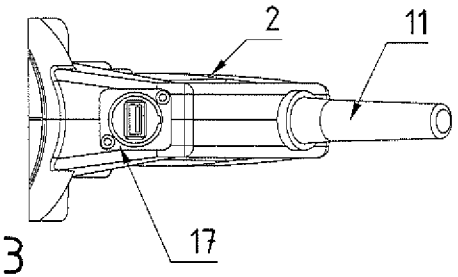
FIG. 3 shows detail III of FIG. 1.

Furthermore, the handle 2 includes a data output 17 (FIG. 3), which at least likewise is connected to the control device 12 and also to the torque sensor 7. To the data output 17 an external data carrier 17*a* can be connected, for example a computer with data carrier. Via the data output 17, e.g. the measured torques and the switch-off time can be output.

By means of the rotary joint 4 between motor 3 and switch-over transmission 5, motor 3 and handle 2 can be rotated with respect to the remaining part of the nut runner 1, in order to bring the handle 2 into a comfortable and safe working position.

By means of the switch-over transmission 5, the operation of the nut runner 1 can be switched to and fro between a fast gear and a low gear. For this purpose, the switch-over transmission 5 includes a rotary switch 18. In the fast gear, it is possible to operate at maximum speed with reduced torque. In the low gear, on the other hand, it is possible to operate with maximum torque at reduced speed.

The planetary transmission 6 serves for generating large torques, for example 150 Nm to 13,000 Nm. At its input or drive end, the planetary transmission 6 is driven by the motor 3. At its output or driven end, an output shaft 19 is located, to which the output square 9 is attached, on which the exchangeable slip-on socket 10 is mounted.

In circumferential direction around the output shaft 19 the torque sensor 7 extends as closed ring, which will be described in detail in connection with FIGS. 7 to 12.

On the output shaft 19 the support arm 8 is fixed, wherein between output shaft 19 and support arm 8 a plain bearing 20 is arranged. The support arm 8 supports on the screw construction or on adjacent screws, in order to generate the counter-torque.

In the exemplary embodiment shown in FIG. 1, the evaluation unit 13 is arranged in the handle 2 of the nut runner 1. The electronic component 16 shown in FIG. 2 in this case also contains the evaluation unit 13. The evaluation unit 13 receives the measured torques from the torque sensor 7, compares the same with the setpoint torque and upon reaching the setpoint torque provides a switch-off signal to the control device 12.

Power and data cables 21 installed in the interior of the nut runner 1 connect torque sensor 7, evaluation unit 13, control device 12 and data output 17 with each other. Furthermore, data can be output at the data output 17 in a cable-bound manner.

Figure 4:
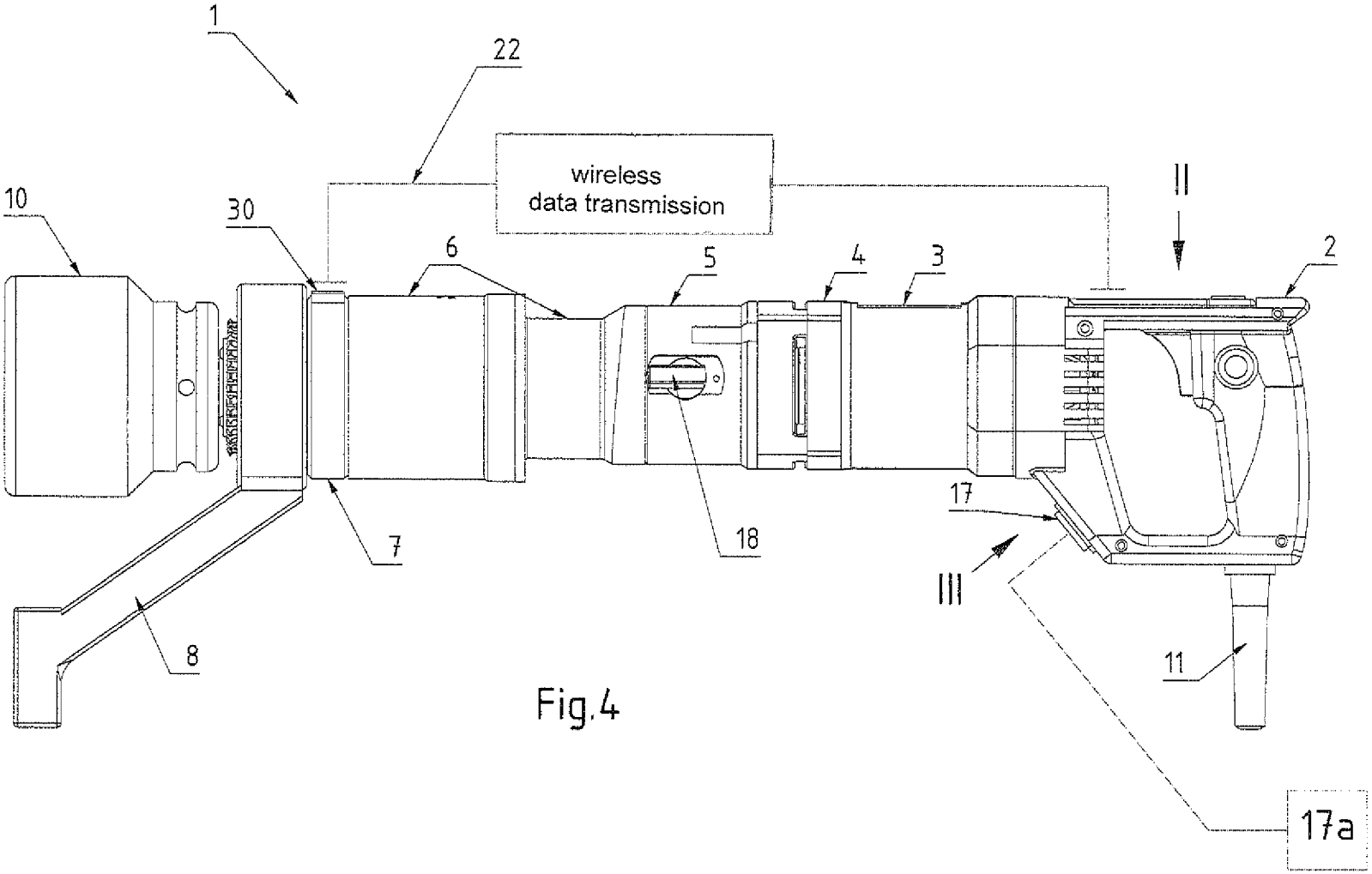
FIG. 4 shows a side view of a second embodiment of a nut runner according to the invention.

In the exemplary embodiment shown in FIG. 4 the evaluation unit 13 likewise is arranged in the nut runner 1, but the data transmission between torque sensor 7, evaluation unit 13 and control device 12 is effected by a wireless connection 22. At the data output 17, on the other hand, the data still are provided via power and data cables extending in the nut runner 1 and the data can be output at the data output 17 in a cable-bound manner.

Figure 5:
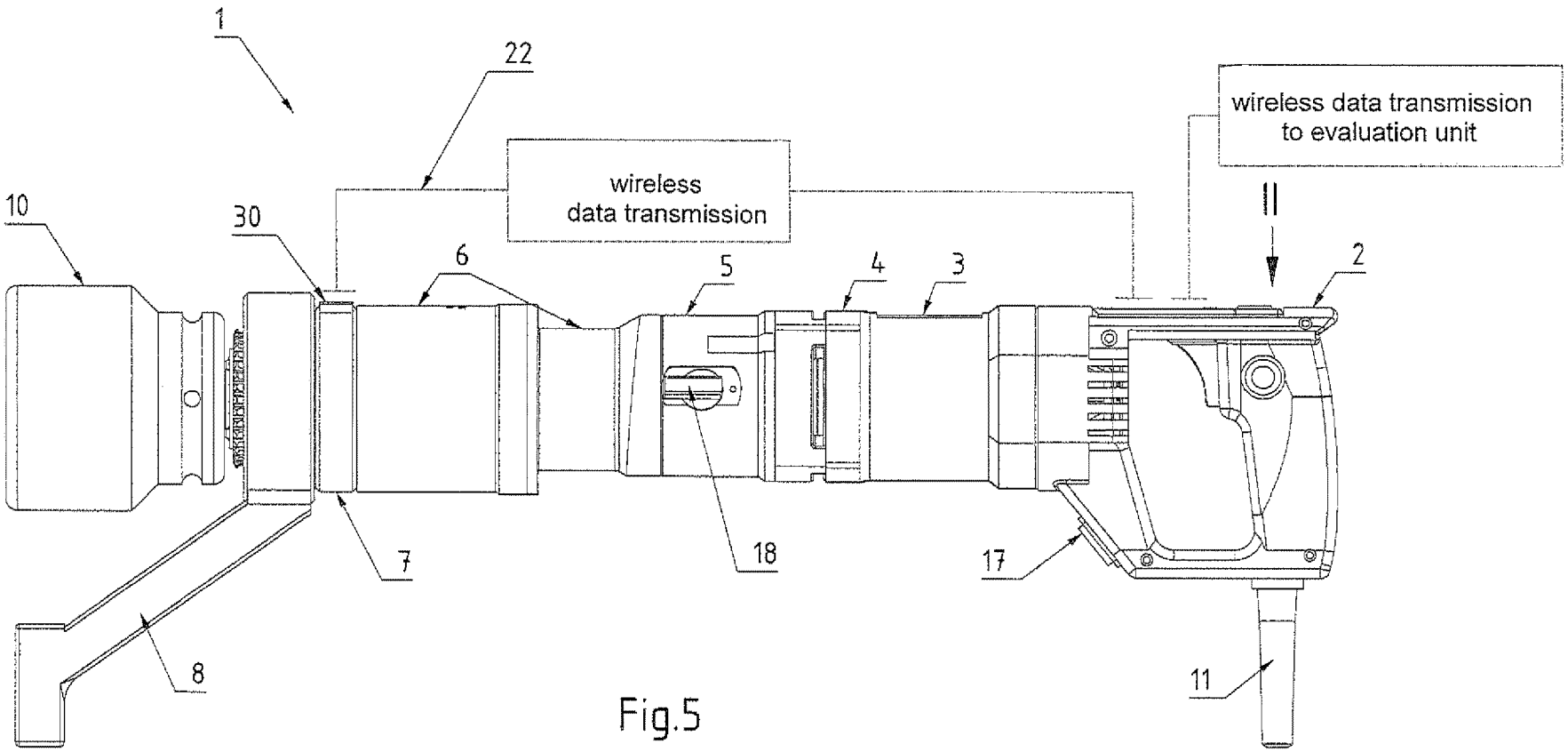
FIG. 5 shows a side view of a third embodiment of a nut runner according to the invention.

In the exemplary embodiment shown in FIG. 5 the evaluation unit 13 is arranged outside the nut runner 1, and like in the exemplary embodiment according to FIG. 4 a wireless data transmission connection 22 exists between the torque sensor 7 and the control device 12. In the exemplary embodiment according to FIG. 5, however, a wireless connection exists between the control device 12 and the evaluation unit 13 and the data output 17 for the wire-bound output of data is replaced by a data output 17 for a wireless output of data.

Figure 6:
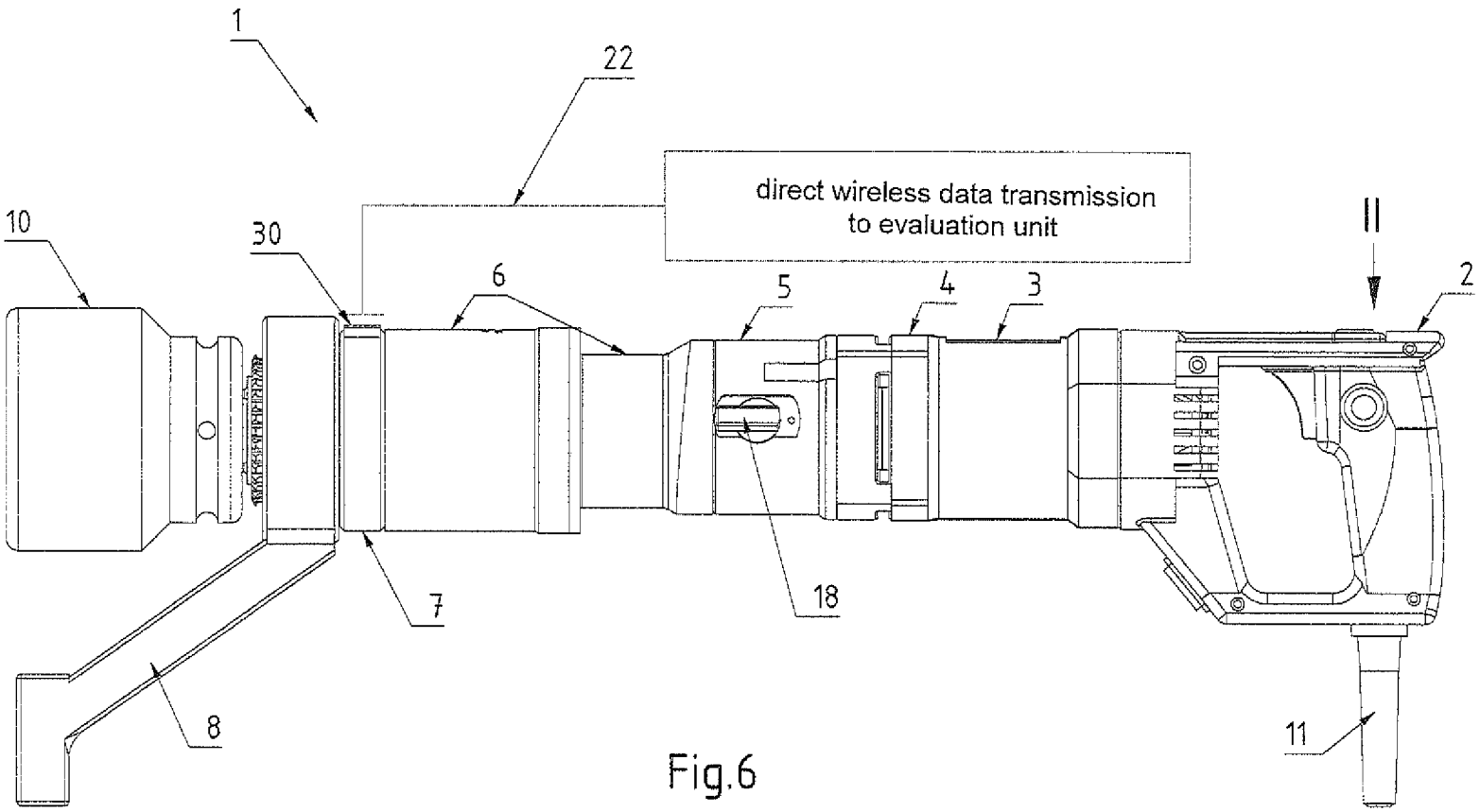
FIG. 6 shows a side view of a fourth embodiment of a nut runner according to the invention.

In the exemplary embodiment shown in FIG. 6 the evaluation unit (not shown) is arranged outside the nut runner 1 and like in the exemplary embodiment according to FIG. 5 all data transmissions are effected via wireless data transmission connections 22, but the measured torques are transmitted directly from the torque sensor 7 to the external evaluation unit in a wireless manner. Upon reaching the setpoint torque, the evaluation unit wirelessly transmits the switch-off signal to the control device 12 present in the nut runner 1, which thereupon switches off the motor 3. The electronic component 16 shown in FIG. 2 in this case only contains the control device 12, the display 14 and the input or setting device 15 for entering the setpoint torque.

Consideration also is given to equip the data output 17 to the end that it preferably wirelessly transmits the measured torques to an evaluation unit 13, receives the switch-off signal from the evaluation unit 13 and thereupon transmits the switch-off signal to the control device 12, so that the same switches off the motor 3.

Figure 7:
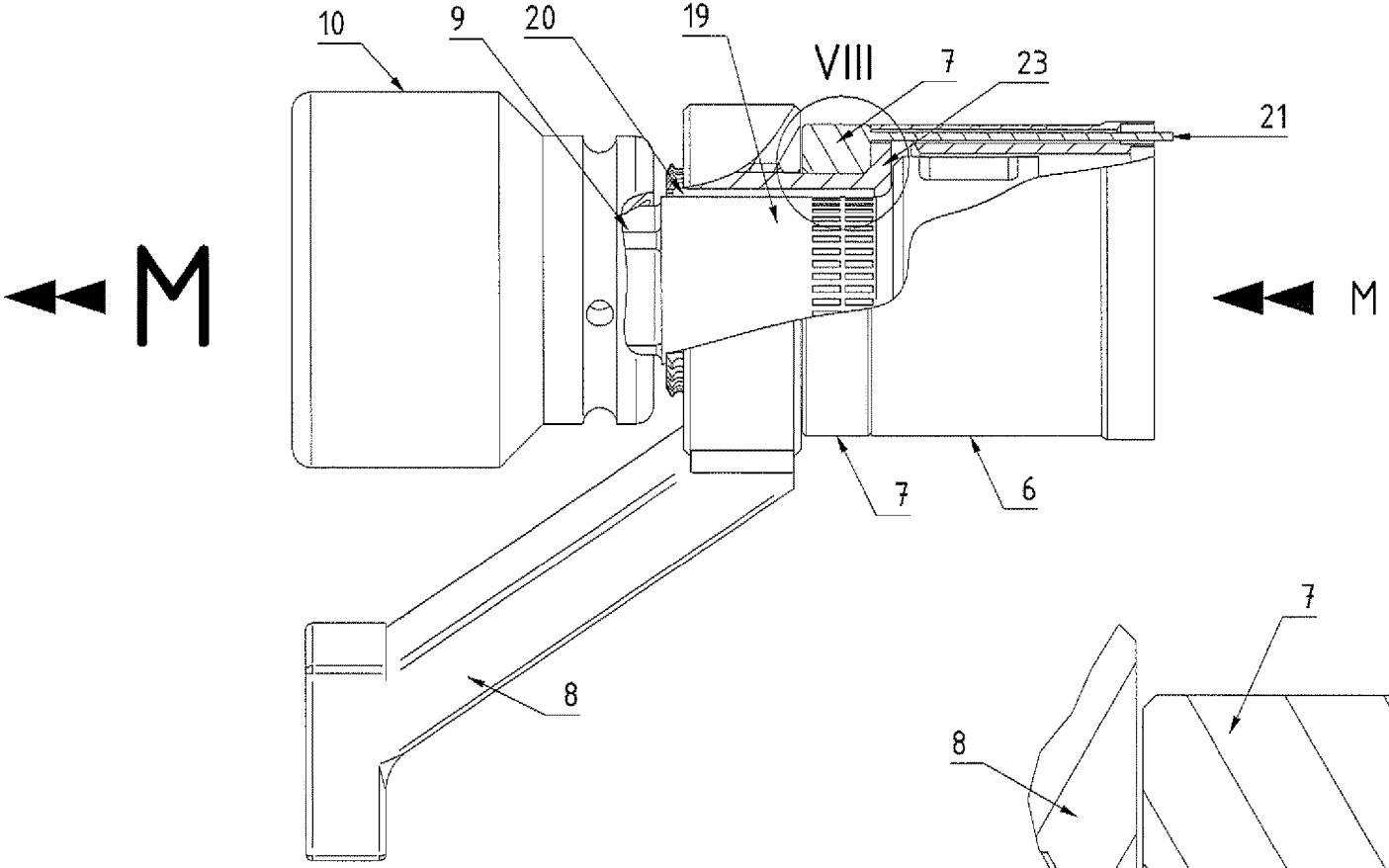
FIG. 7 shows a side view partly cut open of the front part of the nut runner of FIG. 1, with a first embodiment of a torque sensor.

In FIG. 7, the front part of the nut runner 1 of FIG. 1 is shown in a partly cut open side view with the front part of the planetary transmission 6, the torque sensor 7, the support arm 8 and the output square 9 with slip-on socket 10. The double arrows designated with "M" indicate the direction of rotation of the torque.

Figure 8:
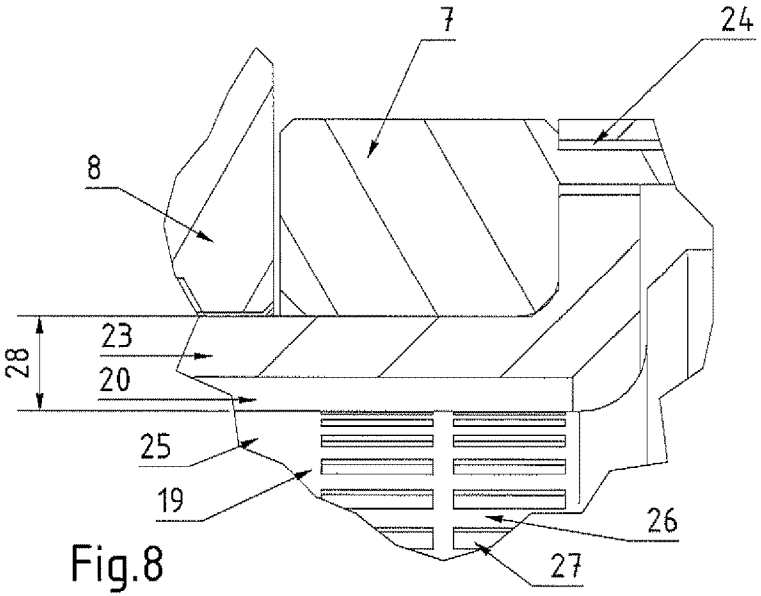
FIG. 8 shows detail VIII of FIG. 7.

In FIG. 8, the detail VIII is shown on an enlarged scale.

In the embodiment shown in FIGS. 7 and 8, the torque sensor 7 is arranged on the outside of the nut runner housing 23 and via a cable connection 21 connected at least with the evaluation unit 13 and the data output 17. The cables 21 extend in a cable duct 24 in the wall of the nut runner housing 23.

In the outer wall 25 of the output shaft 19 two rows parallel to each other each with a plurality of oblong depressions 26 extending in longitudinal direction of the output shaft 19 extend in circumferential direction. The depressions 26 of the two rows face each other at a specified distance in longitudinal direction of the output shaft 19 and are arranged at a constant distance to each other in circumferential direction.

In the depressions 26 elements 27 are arranged, which respond to a torsion of the output shaft 19. Such elements 27 for example can be magnets, optoelectronic elements or strain gauges.

In the exemplary embodiments shown here, the depressions 26 contain magnets 27.

Between the output shaft 19 and the nut runner housing 23 and hence also between the magnets 27 and the nut runner housing 23 a plain bearing 20 is arranged, in order to ensure that the output shaft 19 rotates in the nut runner housing 23 with as little friction as possible.

The torque sensor 7 measures changes in the magnetic field, which are obtained in the magnets 27 due to the torsion of the output shaft 19 upon generation of the torques and likewise change with the change in torque.

The distance 28 between the side of the torque sensor 7 facing the output shaft 19 and the outer wall 25 of the output shaft 19 or the magnets 27 arranged therein is so small that a proper torque measurement is ensured. The thickness of the nut runner housing 23 is adapted correspondingly in this region.

Figure 9:
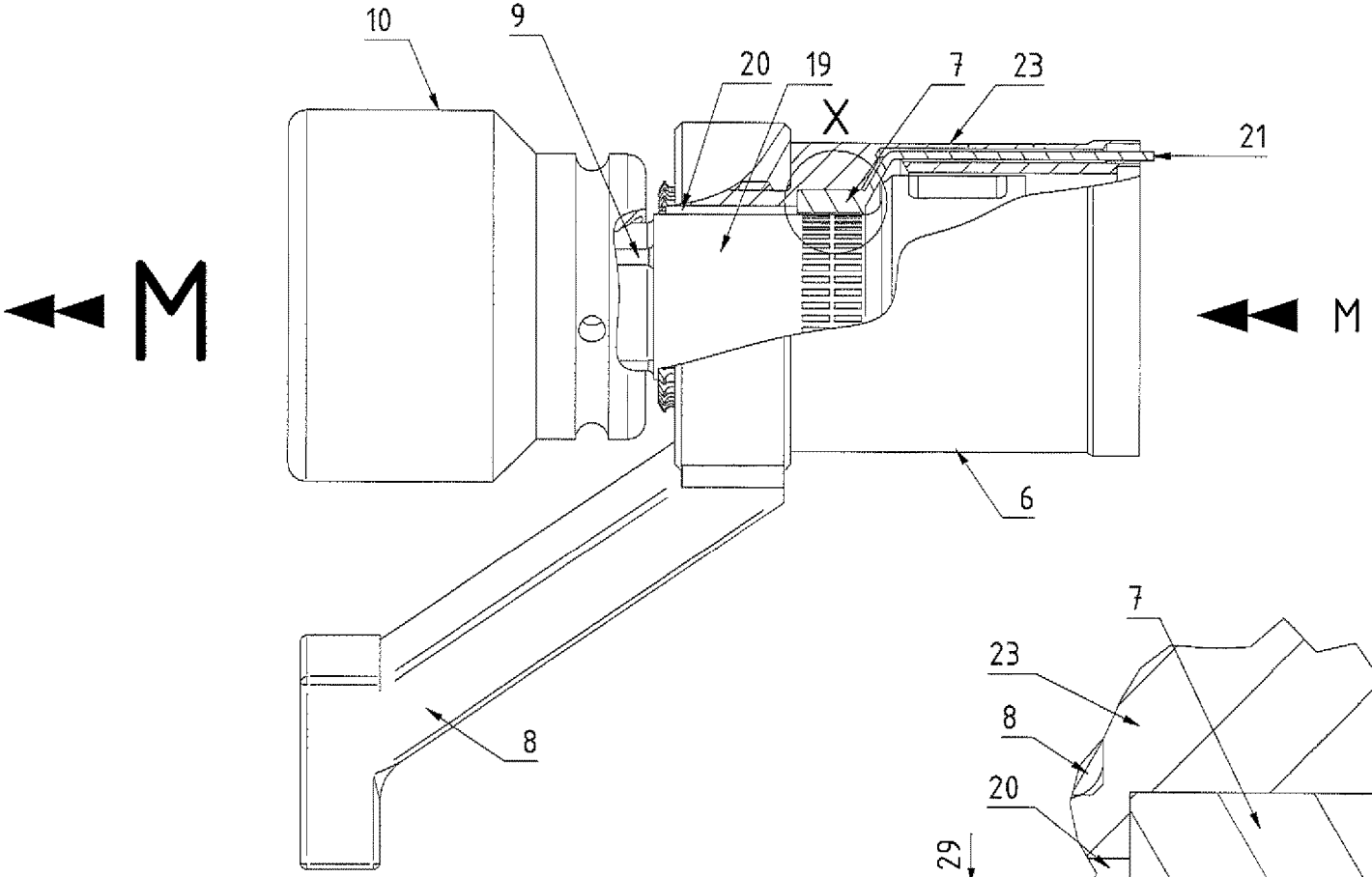
FIG. 9 shows a side view similar to FIG. 7, with a second embodiment of a torque sensor.
Figure 10:
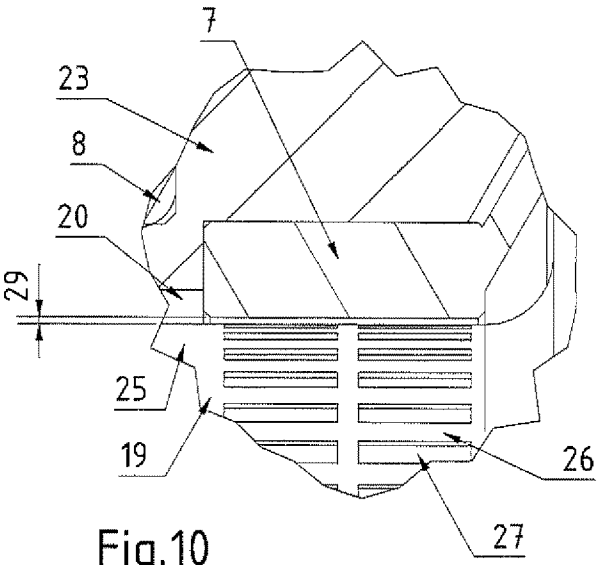
FIG. 10 shows detail X of FIG. 9.

FIG. 9 with a representation of the detail X in FIG. 10 shows a representation similar to FIG. 7 of a further exemplary embodiment of a nut runner 1 according to the invention. In the exemplary embodiment shown in FIGS. 9 and 10, the torque sensor 7 is arranged within the nut runner housing 23 and faces the magnets 27 of the output shaft 19 with a small air gap 29. The data transmission, e.g. to the evaluation unit 13 and to the data output 17, here also is effected via cables 21, which extend in a cable duct 24 in the nut runner housing 23.

Figures 11, 12:
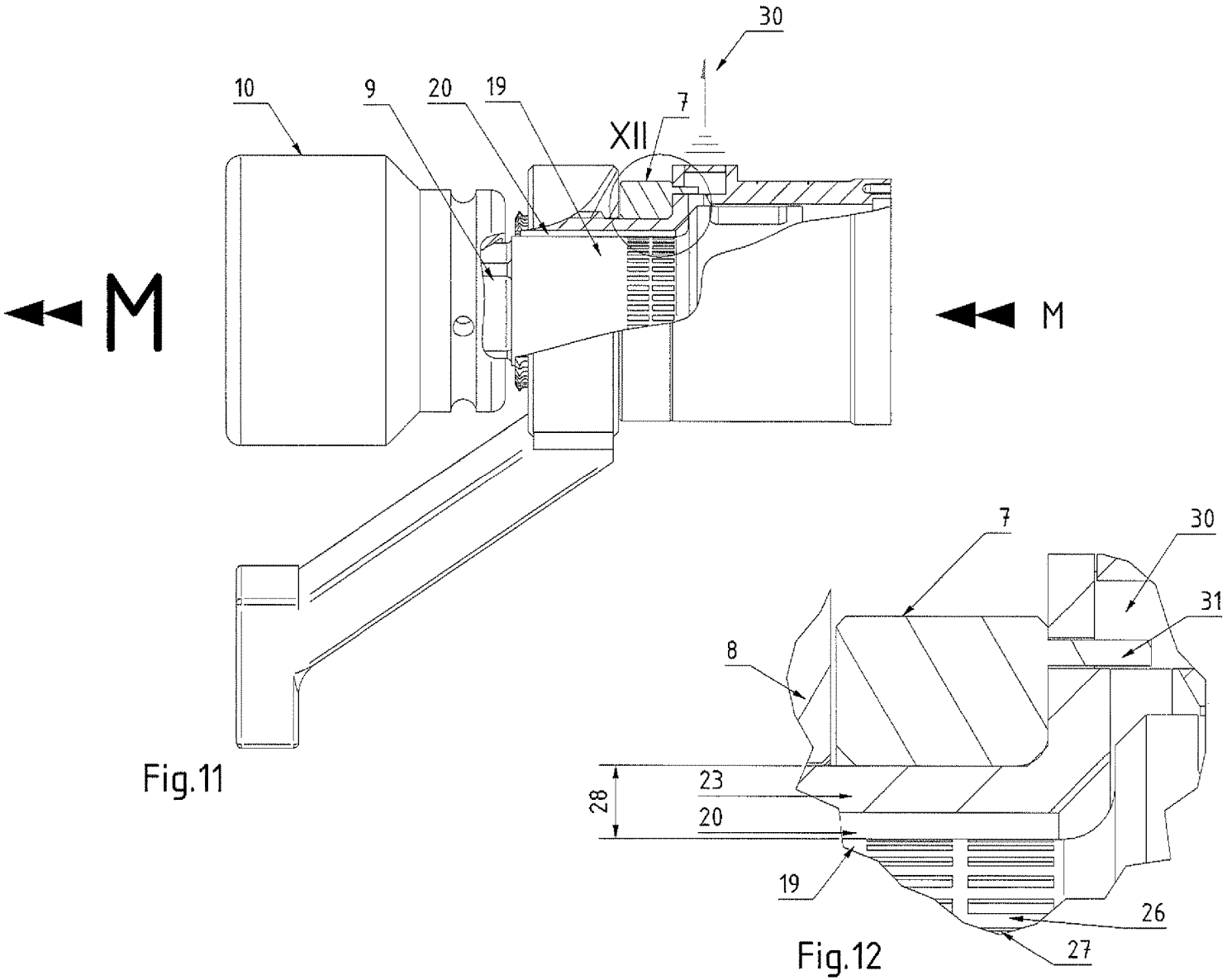
FIG. 11 shows a side view of the front part of a nut runner of FIG. 4, 5 or 6, with a third embodiment of a torque sensor.
FIG. 12 shows detail XII of FIG. 11.

FIGS. 11 and 12 in similar representations as in FIGS. 7 to 10 also show a further exemplary embodiment of a nut runner 1 according to the invention. Like in the exemplary embodiment according to FIGS. 7 and 8, the torque sensor 7 here also is arranged on the outside of the nut runner housing 23. The data transmission, e.g. to the evaluation unit 13 and to the data output 17, in this exemplary embodiment however is effected in a wireless manner. For this purpose, a transmitter 30 is arranged in the nut runner housing 23, which via a data line 31 is connected with the torque sensor 7 and wirelessly forwards the measured torques. The evaluation unit can be located in the nut runner 1 or be accommodated externally.

The invention claimed is:

1. A nut runner, comprising a motor for generating a torque, a tool holder which is operatively connected with the motor and transmits the generated torque to a tool, the tool holder being configured to receive a slip-on tool, a measuring device which continuously measures at least one measurement quantity for determining the torque and forwards the measurement value, a control device which is connected with the motor and the measuring device and controls the operation of the motor such that after starting it generates a continuously increasing torque, and which switches off the motor upon reaching a set point measurement value, wherein the measuring device is a torque sensor (7) and the torque sensor (7) is arranged between the motor (3) and the tool holder (9), wherein the torque sensor (7) is arranged in output direction directly before the tool holder (9) or a support arm (8) and wherein a planetary transmission (6) is arranged between and is operatively connected with motor (3) and tool holder (9); and the torque sensor (7) is part of the planetary transmission (6) and wherein elements (27) are arranged in an outer wall (25) of an output shaft (19) of the planetary transmission (6) and respond to the torsion of the output shaft (19) and wherein the torque sensor (7) is adapted to measure such response of the elements (27).

2. The nut runner according to claim 1, wherein the motor (3) is an electric motor.

3. The nut runner according to claim 1, wherein the torque sensor (7) and the control device (12) are connected with an evaluation unit (13) to which the torque sensor (7) forwards the measured torques and from which the control device (12) receives a switch-off signal for switching off the motor (3) upon reaching a set point torque.

4. The nut runner according to claim 3, wherein the evaluation unit (13) is arranged outside the nut runner (1).

5. The nut runner according to claim 1, further comprising a wireless data transmission connection (22) between torque sensor (7) and evaluation unit (13) or between evaluation unit (13) and control device (12) or between control device (12) and motor (3).

6. The nut runner according to claim 1, further comprising a data output (17) for receiving the measured torques and for transmitting the same to an external data carrier (17*a*).

7. The nut runner according to claim 6, wherein the data output (17) is equipped to wirelessly transmit the measured torques to an external data carrier (17*a*).

8. The nut runner according to claim 6, wherein the data output (17) is equipped to transmit the measured torques to an evaluation unit (13) in a wireless manner, to receive the switch-off signal from the evaluation unit (13) and to transmit the same to the control device, in order to switch off the motor (3).

* * * * *